US005901961A

United States Patent [19]

Holland, III

[11] Patent Number: 5,901,961

[45] Date of Patent: May 11, 1999

[54] REACTION SPEED TIMING AND TRAINING SYSTEM FOR ATHLETES

[76] Inventor: Don Charles Holland, III, 9345 Colburn-Culver Rd., Sandpoint, Id. 83864

[21] Appl. No.: 08/740,736

[22] Filed: Nov. 4, 1996

[51] Int. Cl.[6] ..... A63B 69/00

[52] U.S. Cl. ..... 273/445

[58] Field of Search ..... 273/440, 445, 273/446, 454, 455; 434/258; 463/7, 8, 50, 51, 5

[56] References Cited

U.S. PATENT DOCUMENTS

| | | | |
|---|---|---|---|
| 3,933,354 | 1/1976 | Goldfarb et al. | 273/1 E |
| 4,261,563 | 4/1981 | Goldfarb | 463/7 |
| 4,702,475 | 10/1987 | Elstein et al. | 273/1 GC |
| 4,846,467 | 7/1989 | Rosson | 273/1 GE |
| 4,974,833 | 12/1990 | Hartman et al. | 272/76 |
| 5,165,698 | 11/1992 | Vanderhye | 273/445 |
| 5,289,389 | 2/1994 | Keller | 364/551.01 |
| 5,605,336 | 2/1997 | Gaoiran et al. | 273/445 |

*Primary Examiner*—George Manuel
*Attorney, Agent, or Firm*—Keith S. Bergman

[57] ABSTRACT

A system and particular components are disclosed to measure the reaction time of a user from a signal to start an athletic activity to the start of that activity and the completion time from the start to the finish of that activity. A remote control device responsive to manual input initiates a start signal and a signal to direct that activity toward one or more sensor pads to a user and to a data processor. One or more floor pads sense the presence of the user and signal the user's non-presence to the data processor. One or more sensor pads positioned spacedly distant from the floor pads sense manual contact by the user and signal that event to the data processor. The data processor determines the reaction time and the completion time of an activity from the times of the received signals, annunciates these times in visually cognizable form and stores the data. The sensor pads are compound in nature and provide structure that requires a particular type of contact or contact force above an adjustable predetermined threshold amount to signal completion time.

5 Claims, 5 Drawing Sheets

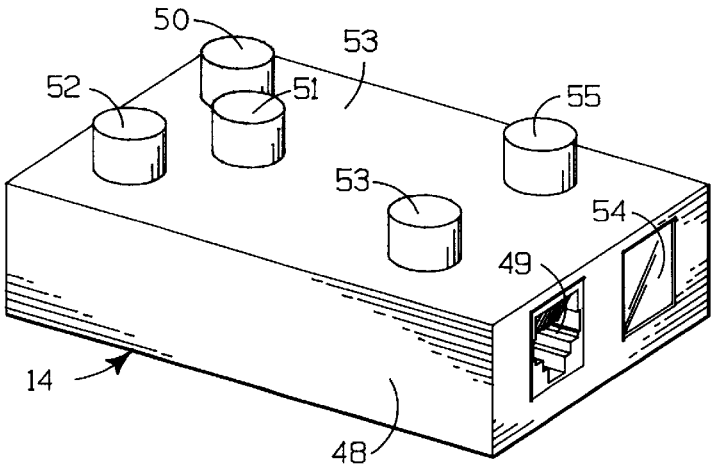
FIG. 4
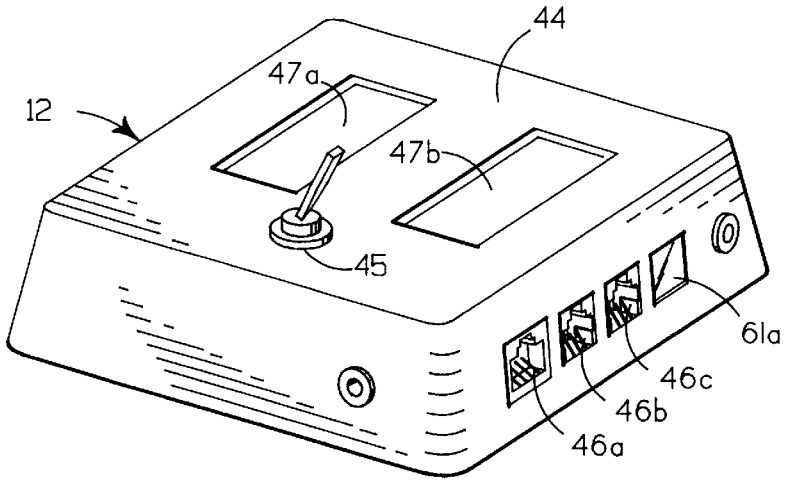
FIG. 5
FIG. 6
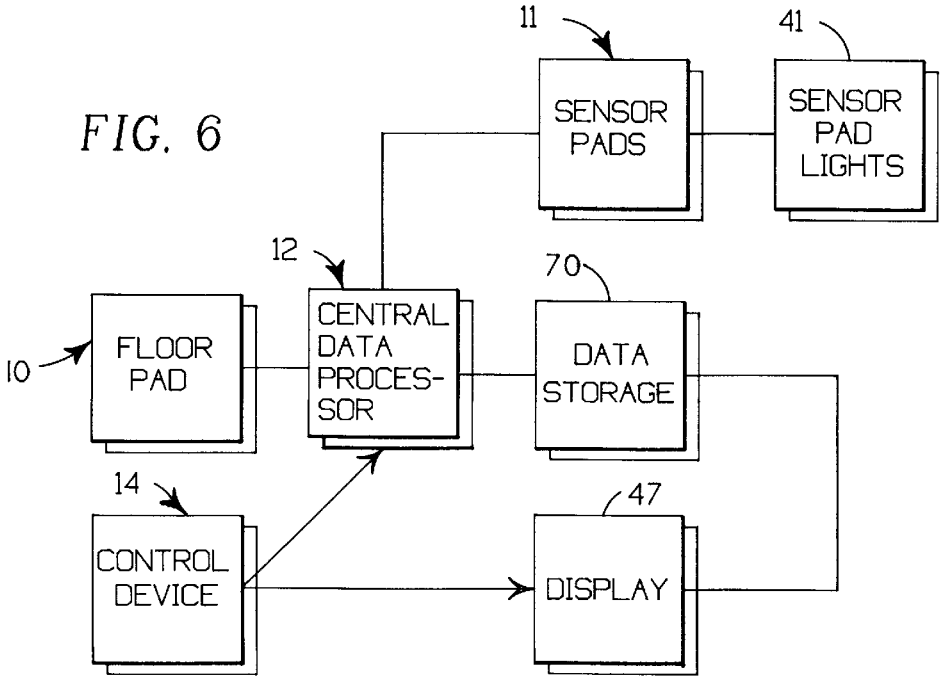

REACTION SPEED TIMING AND TRAINING SYSTEM FOR ATHLETES

BACKGROUND OF INVENTION

There are no applications related hereto heretofore filed in this or any foreign country.

FIELD OF INVENTION

This invention relates generally to timing systems for athletic activities and more particularly to such a system to measure, annunciate and store data of the reaction time from a start signal to the start of an activity and the time thereafter for the activity.

BACKGROUND AND DESCRIPTION OF PRIOR ART

Timing devices have long been known and used to measure the elapsed time consumed by various athletic activities and in some instances that measurement may be directly determinative of the outcome of the activity such as in racing events of various sorts. Though such timing devices have had a lengthy history and their development throughout that history has brought them to a point of substantial sophistication, such devices generally have sensed only the elapsed time from giving a start signal to the completion of the activity and have not been concerned with the reaction time from a start signal to the actual start of an activity. My system measures not only the elapsed time for completion of an athletic activity after a start signal, but also measures the reaction time from a start signal to the actual start of the activity.

Reaction times of various sorts have heretofore been measured, but in general such measurements have been of an abstract scientific type carried out in laboratory type surroundings largely for research purposes such as in the field of psychology. Generally in the past the measurement of reaction times prior to commencement of athletic activities has not been considered important and those reaction times have been largely ignored as such and were merely included in undifferentiated fashion in overall times required for the completion of a particular activity from a start signal.

As sporting activities have developed and become more popular, they have in the present day reached a high degree of sophistication and have substantially increased their position in the economic continuum. By reason of these developments, reaction times of athletes as related to the total time required to complete athletic activities have come to be recognized and have become increasingly important, until at present time reaction times are considered as an important factor both in evaluating the potentiality of athletes and in training athletes to improve their skills to lessen reaction times.

Prior athletic timing devices that have sensed only completion time of a particular activity after a start signal have generally required and provided only one sensor to determine the completion of the activity by one athlete, such as touch pads for swimmers or tapes of various sorts for foot racers. The instant timing system differs essentially from this class of devices by providing two separate and distinct sensors or groups of sensors, the first sensors to sense the time of actual start of athletic activity after the giving of a start signal and the second sensors to sense the time of completion of that activity, so that the difference in time between a start signal and the start of the activity determines reaction time, the period from the start of activity to completion determines the time period for actual completion of the activity, and the sum of these two times determines the traditional time for completion of the activity after a start signal. In my system, the various time measurements are on a real time basis as directly determined by a data processor, and the elapsed time periods are indirectly determined by the data processor by computation.

The sensor that determines the start of an activity comprises a floor pad that senses the physical presence of an athlete by a pressure sensitive switch that provides an electronic signal to the data processor responsive to the athlete's absence. The floor pad is variously positionable relative to the other components of my system to provide substantial flexibility and may communicate with other system components by wireless means to avoid the limitations and hazards of wiring. Prior timing devices in distinguishment generally have not provided such an element, but rather have measured only starting times from a start signal without any measure for the actual start of the activity.

My sensor pads that determine completion of an activity provide position sensitive switches embodied in compound sensor pads of variable size. These sensor pads may be variously positioned relative to each other and relative to the other system components, especially the floor pad, to simulate a variety of athletic activities. For instance a plurality of sensor pads may be positioned in spaced horizontal array at a height approximately thirty inches above a floor and at a distance from the floor pad to allow simulation of blocking activity by a football lineman; one or more sensor pads may be positioned at a height of seven or eight feet above the floor pad to simulate the activity of volley ball spiking or at a distance of approximately one foot above a floor to simulate digging and pickup activity; one or more sensor pads may be positioned approximately two feet above the floor to stimulate guarding by basketball players or eight to ten feet above the floor to simulate rebounding or shot blocking; one or more sensor pads one to two feet above a floor may simulate fielding by baseball players; and other similar athletic activities may be simulated by various arrays of one or more sensor pads and floor pads. Prior athletic timers in distinction not only have not provided reaction time measuring means, but also have not provided a plurality of activity completion sensors that may be variously arrayed relative to each other for an individual user to simulate various athletic activities.

Various sensor pads that have heretofore been used in athletics generally have only sensed contact with the sensor pad in general and have not distinguished or differentiated between contacts of various types. In various athletic endeavors, however, the nature of a contact with a sensor pad, such as the force of contact, the duration of contact, the number of times of contact and the like may be important factors in determining proper completion of a particular event. The instant sensors in contradistinction provide a compound sensing pad of some areal extent that has a spring-loaded movable portion that requires contact of a particular nature to produce a signal. The nature of this contact generally is determined by the amount of force of the contact, but prerequisite conditions to signaling also may be based on other factors. My sensor pads are further distinguished in that they provide a sensible indicia, generally a light, to allow random selection by a controller to indicate which of a plurality of sensors is to be contacted by a user to complete an activity which provides a randomness factor that is related to the reaction and completion time measurements. This sensor pad selection may be made before or after a start signal, but more commonly it is the start signal.

My invention resides not in any one of these features individually, but rather in the synergistic combination of all of its structures that necessarily give rise to the functions flowing therefrom as specified and claimed.

SUMMARY OF INVENTION

My invention generally provides a system to measure reaction time from a start signal to the actual start of an activity and the time thereafter for completion of the activity and to process, store and annunciate data concerning such times.

The system provides a control device, one or more floor pads, one or more sensor pads and a data processor operating peripheral annunciating means. The control device simultaneously provides a start signal to an annunciator sensible to a user and to the central processor. The floor pads sense the presence of a user and signal his non-presence to the data processor. The sensor pads, arrayed at a distance from the floor pads and spacedly distant from each other, signal contact by a user to the data processor. The sensor pads transmit a contact signal only upon the occurrence of contact of a particular nature, such as with a predeterminable force, a predeterminable number of discrete contacts or a contact extending over a predeterminable period of time. Each sensor pad has associated indicia such as a light to identify to a user a pad to be contacted for completion of an activity. The central data processor receives signals of the sensed events and, pursuant to software control determines the elapsed time between signals, stores this information and presents the information to the annunciating means for visual display.

A particular sensor pad disclosed provides a spring-biased contact plate that must be contacted with predetermined force to signal a contact. The various components of the system that are distant from each other may communicate by wiring or by ephemeral signals generated by known wireless means.

In providing such a system, it is:

A principal object to measure the reaction time from a start signal to the actual start of an activity and the time thereafter required to complete the activity and to annunciate and store such information.

A further object is to provide such a system with one or more floor pads and one or more sensor pads, all located at a distance from each other, to indicate presence or absence of a user at a particular pad.

A still further object is to provide such sensor pads that are of a compound nature with mechanism to require contact of a particular type, such as with a predetermined force, over a predetermined period or for a predetermined number of times, to provide a signal.

A still further object is to provide such a system in which the floor pads and sensor pads may be arrayed at spaced distances from each other to simulate various common athletic activities to differentiate both reaction times and completion times for those activities.

A still further object is to provide such a system that is of portable nature and comprised of components that may communicate by wire or wireless means.

A still further object is to provide such a system that is of new and novel design, of rugged and durable nature, of simple and economic manufacture and one that is otherwise well suited to the uses and purposes for which it is intended.

Other and further objects will appear from the following specification and accompanying drawings which form a part hereof. In carrying out those objects, however, it is to be understood that accidental features are susceptible of change in design and structural arrangement, with only one preferred and practical embodiment of the best known mode being illustrated and specified as is required.

BRIEF DESCRIPTION OF DRAWINGS

In the accompanying drawings which form a part hereof and wherein like numbers of reference refer to similar parts throughout:

FIG. 4 is an isometric surface view of the control unit of my system.

FIG. 5 is an isometric surface view of the data processor of my system.

FIG. 6 is a block diagram showing the logical relationship of various components of my system.

DESCRIPTION OF THE PREFERRED EMBODIMENT

My system generally comprises one or more floor pads 10 and one or more sensor pads 11, all providing input to data processor 12 controlled by remote control device 14.

Figure 1:
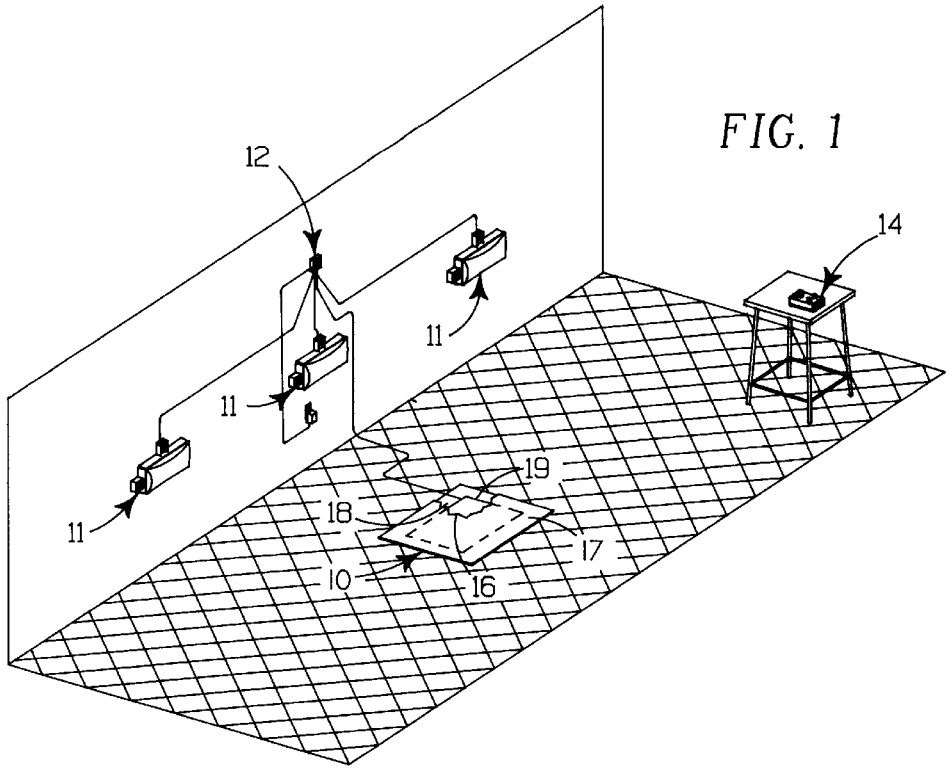
FIG. 1 is a partially cut-away isometric view of my system positioned on a floor and adjacent wall to show its various components and their spatial relationship.

Floor pad 10 is a flat, relatively thin structure, in the instance illustrated in FIG. 1 configured with a rectilinear periphery to provide upper surface 17 and lower surface 16 of some areal extent. The lower surface 16 is interconnected at least peripherally to upper surface 17 to define internal chamber 18 carrying pressure sensitive switch element 19. The switch 19 may sense force between the upper and lower surfaces of the pad or, if the internal chamber 18 is pneumatically sealed the switch may sense gas pressure within the chamber 18, to indicate the presence or non-presence of a system user who is supported on the pad. Preferably the switch element 19 is adjustable to allow differential sensing of one or both feet of a user thereon as determined by the different forces created by the two conditions. This pad structure is not novel in itself, is available in the present day marketplace and therefore is not specified in detail. The size or shape of the pad is not critical, but should be such as to allow a system user to support both feet on the pad.

Figure 2:
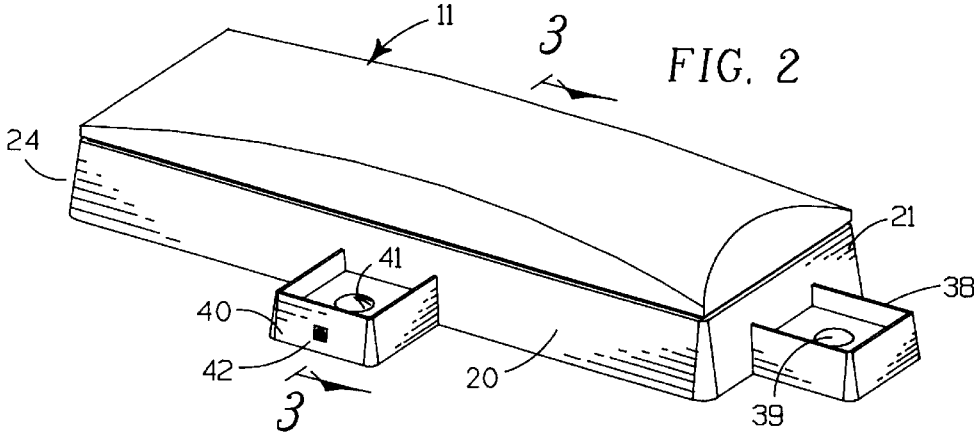
FIG. 2 is an isometric surface view of a sensor pad of my system showing various of its parts, their configuration and relationship.
Figure 3:
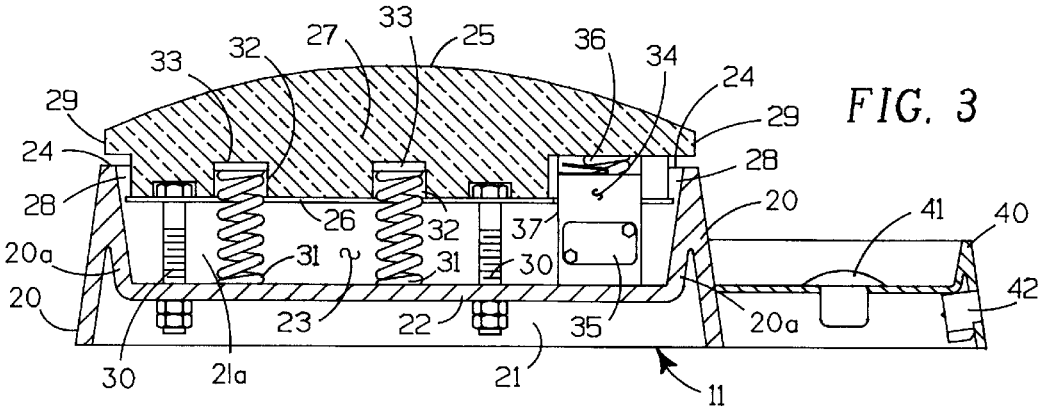
FIG. 3 is a transverse vertical cross-sectional view through the medial portion of the sensor pad of FIG. 2, taken on the line 3—3 thereon in the direction indicated by the arrows.

Sensor pads 11, as shown in FIGS. 2 and 3, each provide a peripherally defined five-sided box-like casement having longer sides 20 interconnected by shorter ends 21, all having coplanar rearward edges, defining a forward orifice 24 and joining back 22 medially positioned between the forward orifice and rearward edges of the peripheral elements to define medial cavity 23. The casement is peripherally configured in the instance illustrated as a truncated rectangular pyramid with rounded vertical edges. The ends and sides are of a complex V-shaped cross-section with inner portions 21*a* and 20*a* respectively angulating somewhat inwardly to join the back 22.

Pad element 25 is movably carried in the cavity 23 of the casement to extend outwardly a spaced distance from orifice 24. The pad element 25 has flat rigid back 26 carrying oblately shaped, outwardly extending padding 27 which is of a configurationally maintaining, coherent type or contained in a peripheral cover (not shown) to maintain its configurational integrity. The rigid back 26 is of size and configuration to fit in a movable relationship through top orifice 24 and into the outer portion of medial cavity 23. At least the inner or rearward portion of padding 27 which fits in cavity 23 must be similarly configured to, and no larger than, the rigid back 26 to allow this motion. Preferably the pad element projecting from cavity 23 somewhat is larger to define a casement facing peripheral groove 28 which provides upper lip 29 to extend peripherally outwardly to cover the periphery of the sensor pad casement defining its forward orifice to protect the structure and adapt it for protection of system users.

Back 26 of pad element 25 is interconnected in spaced relationship to back 22 of the sensor casement by elongate mechanical fasteners, in the instance illustrated comprising nut and bolt combinations 30, which limit the motion of the pad forwardly away from the back but allow limited motion toward the back. Plural compression springs 31 extend between the adjacent surfaces of back 22 and padding 27 to bias the sensor pad element away from the casement back to the forward position limited by nut and bolt combinations 30. In the instance illustrated, the compression springs 31 are carried in cooperating holes 32 defined through the rigid back 26 and spacedly into padding 27 of the sensor pad element for positional maintenance. The compression springs 31 are prevented from extension into padding 27 by rigid washer-like disks 33 adjacent the inner surface of the holes 32.

Indentation 34 is defined in the inwardly facing portion of padding 27 and in the inwardly adjacent portion of back 26 to receive position sensing switch 35 supported on the back 22 of the sensor housing. The rearwardly or inwardly facing surface of the indentation 34 carries inwardly extending contact dog 36 which may be positionally adjusted in a forward-rearward direction to contact and operate switch 35 responsive to positioning of the sensor pad 25 relative to switching lever 37 which operates switch 35.

With this structure then, the outward motion of the sensor pad element 25 away from the sensor pad casement is restrained by nut and bolt combinations 30 and the sensor pad element is biased outwardly by compression springs 31, so that if appropriate rearwardly directed force is applied to padding 27, as determined by the compression springs 31 and sensing switch 35, that force will operate switch 35 to pass an electrical signal to the data processor to indicate that condition.

The casement of each sensor pad 11 carries at each end a fastening ear 38 defining at least one hole 39 to accommodate a mechanical fastener (not shown) such as a bolt or screw to positionally maintain the sensor pad on the surface of a supporting structure. The particular type of fastening of the pads to supports is not critical to my invention and may be accomplished by other known fastening means such as adhesion, hook and loop type fabric fasteners, and the like, which are within its ambit and scope.

Each sensor pad 11 has an associated indicator device, in the instance illustrated comprising light housing 40 carrying light screen 41 and supporting ordinary telephone connector plug 42 to allow wire interconnection of the sensor pad with electrical circuitry interconnecting the other system components. Positioning of this indicator device and even its nature are not critical so long as it serves to indicate to a user the identity of a particular pad. The light may be embodied in fastening ears 38 or may be variously positioned on or about the sensor pad otherwise than as illustrated. The light itself is not essential as an annunciator and may be replaced with some other sensibly cognizable means of identifying a particular sensor to a user.

Data processor 12 receives signals from floor pads 10 and sensor pads 11 to, responsively to an internal program, determine the time of reception of such signals, and provide this data for further processing. Such data processors are not novel in themselves, and have been known and used, in their essence at least, in the electronic and computer arts for various timing of activities. These data processors when used as timers may have high degrees of accuracy, commonly of at least one thousandth of a second or less.

Data processor 12, as seen in FIG. 5, provides casement 44 carrying externally accessible off-on switch 45 and multiple connector ports 46*a*, 46*b* and 46*c*, in the instance illustrated of the telephone type, for wire-type interconnection with other system elements if desired. Infrared input window 61*a* allows light input through the casement to an infrared receiver. The data processor has an associated display, in the instance illustrated comprising two LCD display windows 47*a* and 47*b* carried by casement 44, to display in digital form both reaction time and completion time data. Various other display devices may be associated with my system, including visual displays located at a distance from the central processing unit and controlled thereby (not shown). Data carried in the memory of the data processor may be downloaded for further processing or storage in more sophisticated computer systems.

Control device 14 as seen in FIG. 4 provides casement 48 carrying an oscillator and various switching circuitry which may be interconnected to my system by wiring communicating through telephone type connector 49 carried thereby or other known means not requiring wiring, such as radio signals, infrared signals emitted through window 54 or the like. The control device provides plural pushbutton switches to regulate system operation. Switch buttons 50, 51 and 52 operate respectively the sensor pad identifying indicia, in the instance illustrated comprising light screens 41 carried by the three sensor pads. Reset button 53 resets the system for a start signal to commence some activity to be times. Stop button 55 terminates the operation of a particular cycle of the system.

A block diagram showing various logical components of my system and their relationship is illustrated in FIG. 6 and particular circuits usable in these components are illustrated in FIGS. 7A–C, and 8 an 9.

Figure 8:
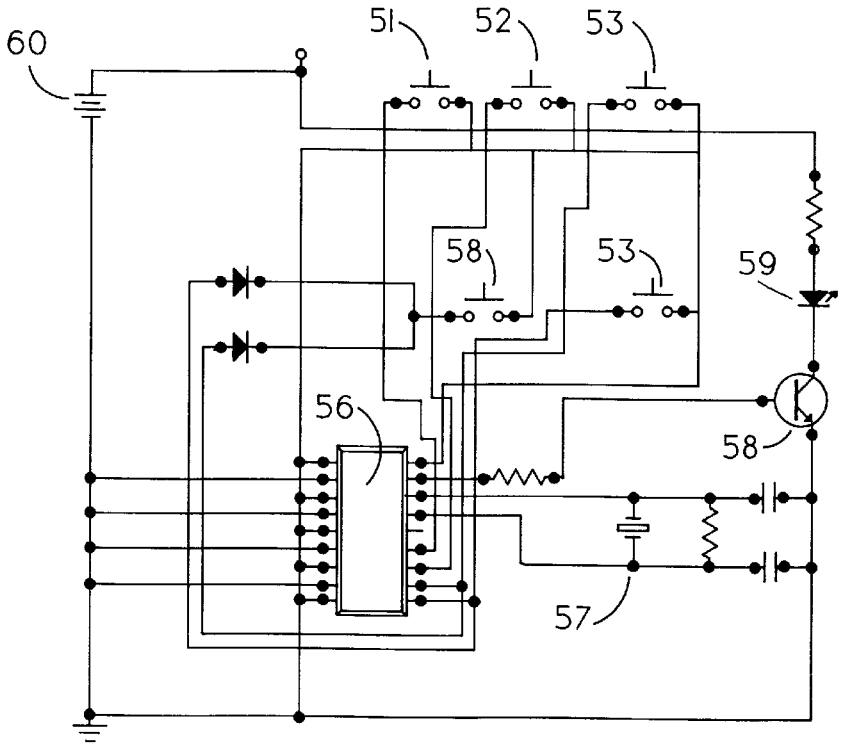
FIG. 8 is an electrical diagram in normal symbology of the remote control device of my system.

As seen in FIG. 8, the control device 14 is activated by switches 51, 52 and 53 which provide binary logic input that is encoded by data processor 56. The encoded signal is mixed with a 38 KHz carrier which is provided by the data processor 56 and oscillator component 57. This output is amplified by transistor 58 and the amplified output is presented to infrared diode 59 for ephemeral transmission of the infrared encoded signal to the data processor, The control device is powered by battery 60 and the system is stopped by stop switch 55 and reset by reset switch 53.

Figure 7A:
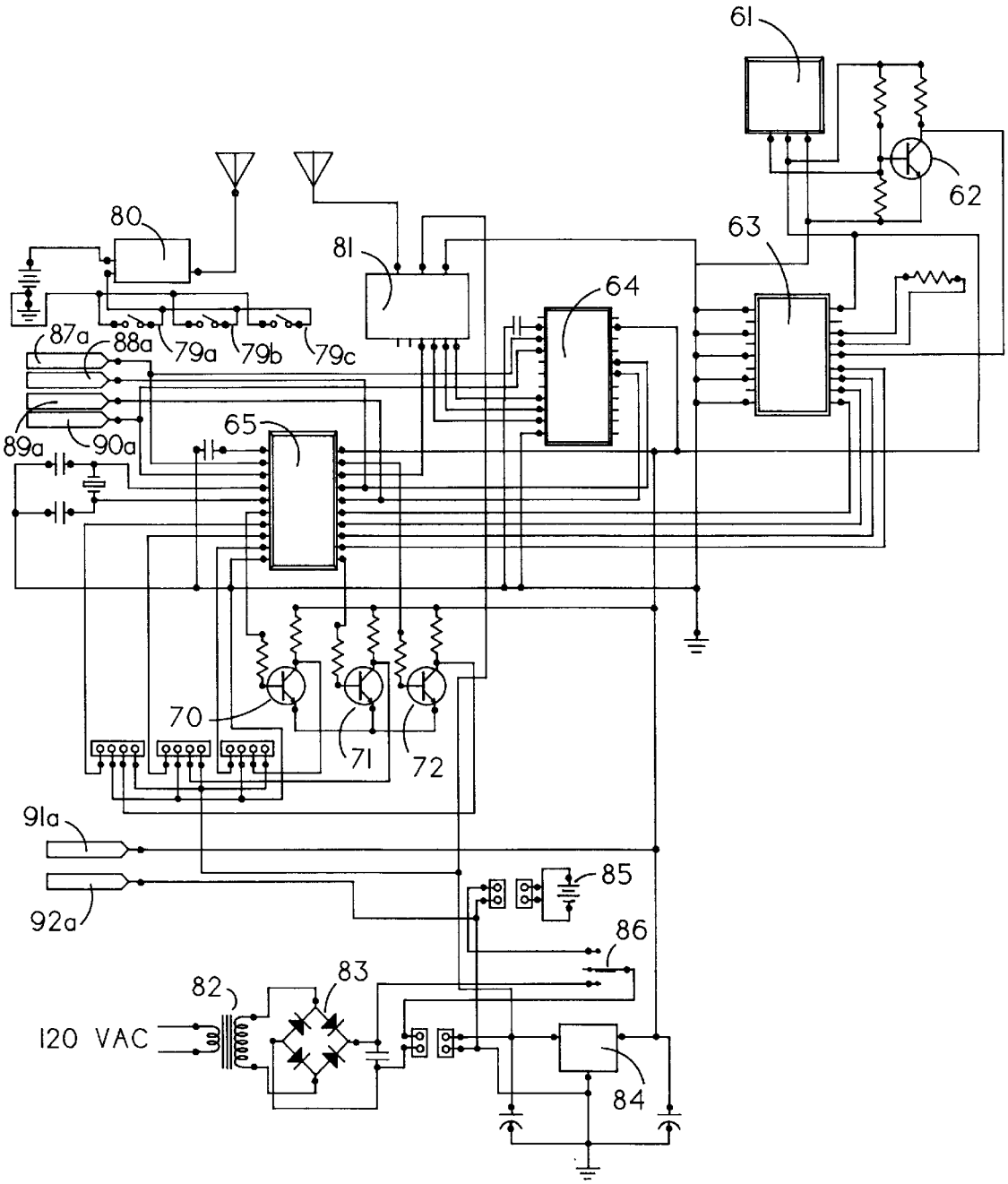
FIG. 7A is an electrical diagram in normal symbology of the data processor of my system.

As seen in FIG. 7A, the infrared encoded signal is received and translated by receiver 61. The then electronic signal is inverted by transistor 62 which is a Glue logic inverter and is passed to decoder 63 where it is decoded and then passed to microcontroller 65 for processing. A particular device that has been found serviceable for use as microcontroller 65 is that produced by ATMEL, 2125 O'Nell Drive, San Jose, Calif. 95131, as its product AT 89C2051 which includes timers and counters, direct LED drive outputs, and an analog comparator among other features. The system operating program is stored in random access memory (RAM) in the microprocessor 64 or 65 which processes up to thirty inputs in the particular circuit illustrated. When the timing sequence is active or when previously stored data in RAM is manipulated, a thirty-six bit stream of serial data is provided by the microprocessors which run at twelve MHz. The data stream is updated at a regular rate of about one MHz which depends upon the particular program stored in RAM.

Figure 7B:
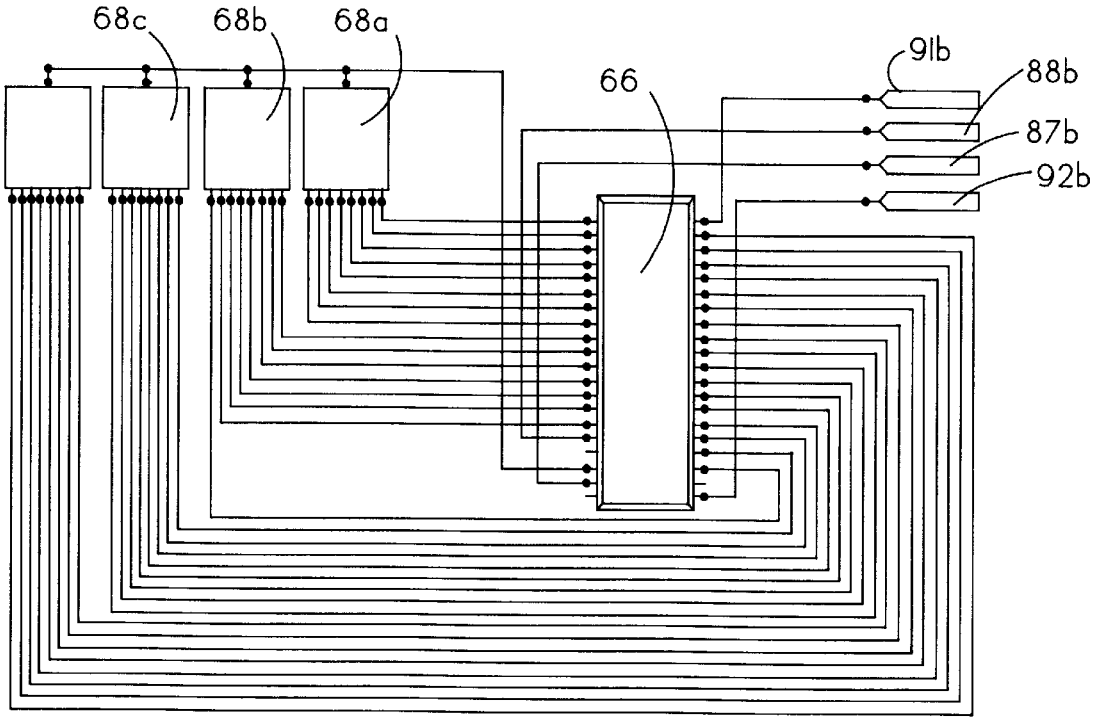
FIG. 7B is an electrical diagram in normal symbology of the reaction time visual display circuitry.
Figure 7C:
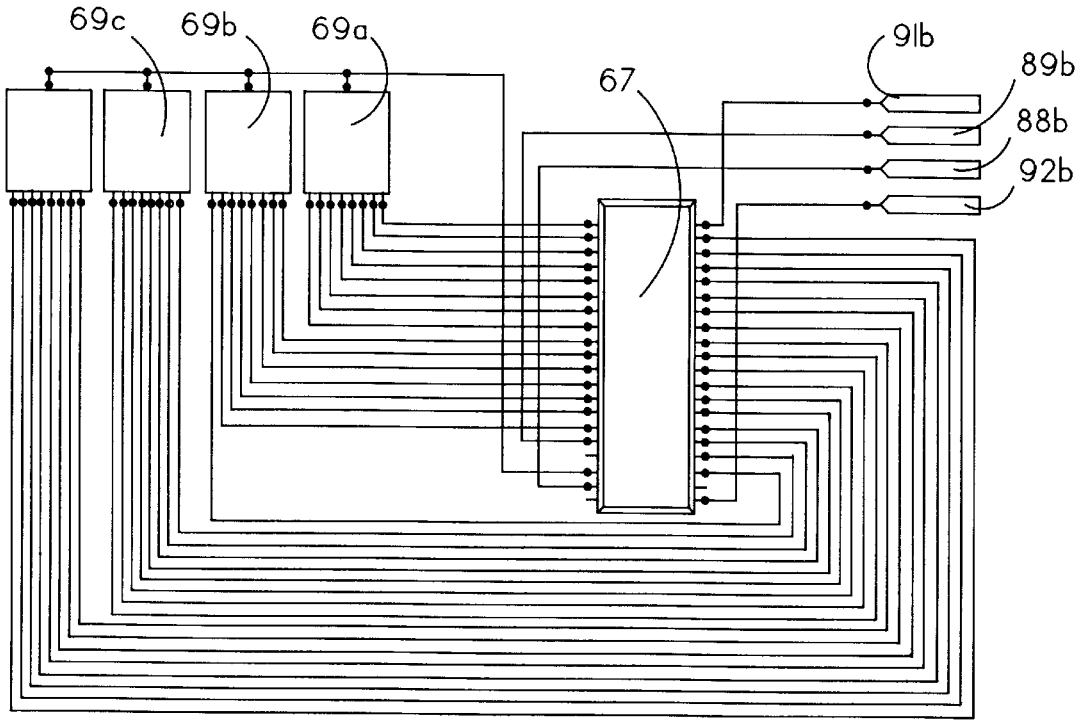
FIG. 7C is an electrical diagram in normal symbology of the completion time visual display circuitry.

The data stream is output through serial ports 87*a*, 89*a* and enabling ports 88*a*, 90*a* to corresponding ports 87*b*, 89*b* and 88*b*, 90*b* of the display elements shown in FIGS. 7B and 7C. These display elements are powered from ports 91*a* and grounded from port 92*a* through the interconnecting ports 91*b* and 92*b*. The data stream is sent to decoder-drivers 66 and 67 for liquid crystal displays (LCD) 68*a–c* and 69*a–c*, associated in pairs for each sensor pad, until the timing sequence is terminated or the mode of operation is changed ON to data previously stored. The LCD's then display in visual numeric form the reaction times and completion times responsive to signals provided by floor pads and sensor pads.

Figure 9:
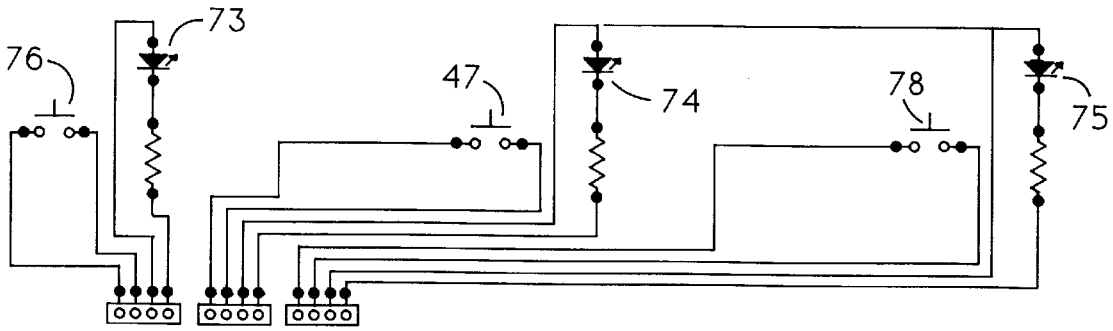
FIG. 9 is an electrical diagram in normal symbology of the sensor pad circuitry of my system.

As seen in FIG. 7A when the microcontroller program calls for the start of timing relating to one of the sensor pads 11*a–c* responsive to a signal from the controller, the signal is amplified by transistors 70, 71 or 72 respectively and the identifying LED clusters 73, 74 or 75 as seen in FIG. 9 is activated responsively to the selection signal from the remote controller. Switches 76, 77 and 78 associated with each sensor pad close when the pad terminates the timing cycle responsive to appropriate force and motion.

Reaction timing stops when one of switches 79*a–c* carried by the floor pad sends an encoded radio frequency signal from transmitter 80. The radio signal is received and decoded by receiver 81 and passed to microprocessors 64 and 65 through separate channels.

Completion time is started simultaneously when the reaction timing stops by the program stored in the RAM of microcontrollers 64 and 65. The completion timing is stopped when one of switches 76, 77 or 78 closes responsive to a sensor pad's activation.

Power for the control device is supplied by a one hundred fifteen volt alternating current power source (not shown). The current is converted to five and twelve volt direct current supplies by transformer 82, rectifier 83 and voltage regulator 84. Auxiliary power is provided through twelve volt battery 85 as selected by switch 86.

The particular circuitry described for control of my system is of a remote microcontroller controlled type not requiring wiring interconnections between the various system elements. This is the preferred form of control system, but it might be readily converted to a hard-wired transistor switched type system by obvious modifications which might be made by a person of ordinary skill in the electrical arts.

Having described the structure of my system, its operation may be understood.

For use floor pad 10 is established on a supporting floor, sensor pads 11*a–c* are established at spaced distances from the floor pad, and from each other, on some supporting object such as a structural wall shown in FIG. 1. A user of the system positions himself with one or both feet on floor pad 10 and the remote control device 14 is maintained at a distance from the user by a system operator. The system operator provides a start signal by selecting a sensor pad to start a timing cycle and the user performs some particular predetermined activity requiring motion from the floor pad and subsequent contact with a sensor pad responsive to the start signal.

The start signal normally is the lighting of a light screen 41 associated with one sensor pad 11*a–c*, but need be only some signal cognizable by the user such as of an audio nature or some other visual nature. Normally the signal will be randomly given by the operator from a position out of the vision of a user so that the user has no prior knowledge of the time of giving a particular signal. An audio signal may be given (by means not shown) to indicate imminence of activity and thereafter a light signal on one of the sensor pads may be activated to determine which pad should be involved in the particular activity and to start the timing cycle. The floor pad and sensor pads may be variously arrayed relative to each other to simulate various activities as previously indicated.

As the start signal is given, the timing cycle commences in the data processor. When the user leaves the floor pad as sensed by the pressure sensing switch element 19, a responsive signal is transmitted to the data processor to allow determination of reaction time. The timing cycle continues until the selected target sensor pad is properly contacted to send a completion signal to the microprocessors to indicate completion time. Both elapsed reaction time and completion time are then determined by the data processor pursuant to a simple program carried in its random access memory. The separate data are displayed in numerical form on displays 68 and 69 of the data processor. Reset button 53 is then depressed to store the sensed data in the microcontroller memory with appropriate identifying information and to reset the circuitry for subsequent operation.

It should be noted that though my invention is illustrated and described as having one floor pad and three sensor pads, the system is operative with multiple floor pads and a greater or lesser number of sensor pads by obvious modifications of the circuitry illustrated and described, if necessary. The floor pads and sensory pads may also all be variously positioned relative to each other and a user may be required to contact more than one sensory pad sequentially to give a completion signal to simulate various types of athletic or other activity. Such variance of these components is within the contemplation, ambit and scope of my invention.

The foregoing description of my system is necessarily of a detailed nature so that a specific embodiment of it might be set forth as required, but it is to be understood that various modifications of detail, rearrangement and multiplication of parts might be resorted to without departing from its spirit, essence or scope.

Having thusly described my invention, what I desire to protect by letters patent, and

What I claim is:

1. A timing system for athletic activities to measure, store and annunciate reaction time, from a start signal until activity commences, and completion time, from commencement of activity until completion, comprising in combination:

a remote control device having first means for giving a start signal to a data processor and a user, second means for selecting and responsively giving a signal to the data processor and user of the identity of at least one of a plurality of sensor pads and third means for giving a signal to the data processor to reset the system;

at least-one floor pad having means for sensing user presence and giving a signal to the data processor of user non-presence;

at least one sensor pad, positioned spacedly from any floor pad, having means for sensing user contact with the sensor pad and responsively giving a signal to the data processor; and the data processor having at least one microcontroller with first means for determining reaction time between the start signal received from the remote control device and the signal of user non-presence received from the floor pad and completion time between the signal of user non-presence from a floor pad to a signal of user contact from the sensor pad, and second means for annunciating and storing reaction time and completion time data.

2. The timing system of claim 1 wherein the sensor pad comprises, in combination:

a box-like casement having means for attachment on a support and defining a cavity extending outwardly away from the support and carrying a padding element for limited motion toward and away from the casement with first means for limiting motion of the padding element away from the casement to maintain at least a part of the padding element in the cavity and second means for biasing the padding element away from the casement.

3. The timing system of claim 2 further having a position sensitive switch carried by the casement to change state upon contact with the padding element when the padding element is at a predetermined position relative to the casement.

4. The timing system of claim 1 having a plurality of sensor pads at a spaced distance from each other and from any floor pad, each sensor pad having an identifying indicia activated by the remote control device to identify a particular sensor pad toward which activity of a user is to be directed.

5. A system for measuring the reaction time of a user, from a start signal to the start of a predetermined activity, and the completion time thereafter, from the start of the activity to completion of the activity, comprising in combination:

a remote control device having first means for providing a start signal to a data processor and to a user, second means for providing a signal to the data processor for resetting the system and third means for providing a signal to the data processor and a user to visually identify at least one of a plurality of sensor pads;

at least one floor pad having a pressure sensitive switch to sense non-presence of a user on the floor pad and means to transmit a signal of user non-presence to the data processor;

the plurality of sensor pads arrayed at spaced distances from the floor pads and at spaced distances from each other, each sensor pad having a casement defining a cavity carrying an outwardly projecting padding element for limited motion in the cavity toward and away from the casement, first means for adjustably limiting the motion of the padding element away from the casement, second means for biasing the motion of the padding element away from the casement, visual indicia to identify each individual sensor pad, and switching means for sensing a predetermined position of the padding element relative to the casement and responsively transmitting a completion signal to the data processor; and the data processor having at least one microcontroller with random access memory and program means, first means to receive signals from the remote control device, second means to receive signals from the floor pads, third means to receive signals from the sensor pads, fourth program means to determine response time, between the start signal received from the remote control device and the signal of user non-presence from the floor pad, and completion time, between the signal of user non-presence from the floor pad and a completion signal from the sensor pad, fifth means for storing response time and completion time data in the random access memory and for selectively retrieving said data from the random access memory, and sixth means for visually displaying selectively response time and completion time data.

* * * * *